United States Patent [19]

Minowa

[11] Patent Number: 4,714,363

[45] Date of Patent: Dec. 22, 1987

[54] PRINT CONTROL DEVICE FOR A DOT MATRIX PRINTER

[75] Inventor: Masahiro Minowa, Shiojiri, Japan

[73] Assignee: Seiko Epson Corporation, Tokyo, Japan

[21] Appl. No.: 736,481

[22] Filed: May 20, 1985

[30] Foreign Application Priority Data

May 18, 1984 [JP] Japan ..... 59-100152
Mar. 14, 1985 [JP] Japan ..... 60-51011

[51] Int. Cl.[4] ..... B41J 19/30

[52] U.S. Cl. ..... 400/322; 400/120; 400/328; 307/41; 318/139; 318/672

[58] Field of Search ..... 400/320, 322, 323, 328, 400/120; 318/672, 345 R, 345 B, 345 F, 346, 139; 346/76 PH, 139 R; 307/34, 38, 41

[56] References Cited

U.S. PATENT DOCUMENTS 4,011,491 3/1977 Grover ..... 318/345 R X
4,037,145 7/1977 Bailey ..... 318/345 R X
4,113,391 9/1978 Minowa ..... 400/120
4,213,714 7/1980 Jones ..... 400/322 X
4,225,251 9/1980 Klimek ..... 400/120 X
4,409,600 10/1983 Minowa ..... 346/76 PH
4,459,050 7/1984 Goldberg ..... 400/322 X
4,510,505 4/1985 Fukui ..... 346/76 PH
4,560,992 12/1985 Hayashi ..... 346/76 PH

FOREIGN PATENT DOCUMENTS 118484 7/1984 Japan ..... 400/322

OTHER PUBLICATIONS

*IBM Tech. Disc. Bulletin,* by P. Short, vol. 23, No. 11, Apr., 1981, pp. 5000-5001, 400-322.

*Primary Examiner*—Paul T. Sewell
*Attorney, Agent, or Firm*—Blum Kaplan

[57] ABSTRACT

A print control device for use with a portable battery powered dot matrix printer has a DC motor which moves a carriage with a dot generating mechanism and is provided with a shaft position signal generator. A control circuit responds to the anglular position of the drive motor to establish a print cycle in which the DC motor and the dot generating mechanism are driven in alternation so as to minimize the rate of power consumption.

12 Claims, 10 Drawing Figures

FIG. 4 (a)
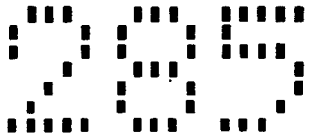
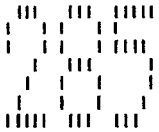
FIG. 4(b)
FIG. 5
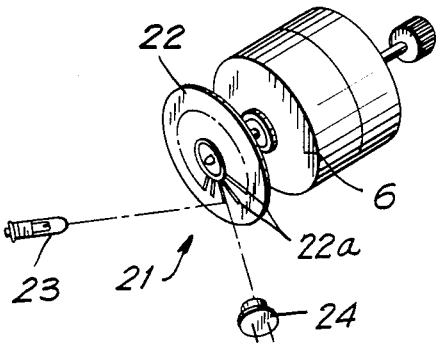

PRINT CONTROL DEVICE FOR A DOT MATRIX PRINTER

BACKGROUND OF THE INVENTION

This invention relates to a print control for a dot matrix printer. More particularly, this invention relates to a print control for use with an information processing device of small capacity, such as a handheld computer having such a printer.

A conventional dot matrix printer includes a dot printing mechanism which is mounted on a carriage. The carriage is movable in the direction of the width of the printing paper. The dot generating mechanism is driven in synchronism with movement of the carriage to print characters or patterns. To harmonize the position of the dot generating mechanism with the timing of the dot generating mechanism, a stepper motor is employed for shifting of the carriage.

With this arrangement, driving of the dot generating mechanism is sychronized with the shifting movement by using a timing signal. However, the source of the timing signal must be capable of supplying high peak powers when the stepper motor is driven. This presents a problem in the case of handheld devices in which a battery cell is used as the power source.

SUMMARY OF INVENTION

According to the invention, a print control device is provided for a dot matrix type printer which has a DC motor for driving the carriage on which a dot generating mechanism is carried in the axial direction along a platen. The DC motor is provided with a detector for determining the angular position of the motor. The detector delivers a signal corresponding to the rotation of the motor. The print control device establishes a forbidden time during which the DC motor is not to be driven and a conducting time during which the dot generating mechanism is energized. Timers establish the duration of the forbidden time and a conducting time controller regulates the duration of power supplied to the dot generating mechanism, each being reset in synchronism with the synchronizing signal from the detecting means.

It is an object of the present invention to provide a control device for regulating the operation of a dot matrix printer which reduces consumption of peak power by the printer.

It is still another object to provide a dot matrix printing apparatus having simply switchable system of the dot generating mechanism.

It is still another object of the invention to provide a dot matrix printing apparatus having reduced peak power consumption in which the printing mode can be switched to provide normal or condensed letters.

It is a further object of the invention to provide a dot matrix printing apparatus having a dot generating mechanism in which duration of the dot generating time for each character is inversely proportional to the square of the available DC supply voltage.

Still other objects and advantages of the invention will in part be obvious and will in part be apparent from the specification.

The invention accordingly comprises the features of construction, combinations of elements, and arrangements of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIGS. 4(*a*) and 4(*b*) are illustrative examples of print patterns produced by the printer of FIGS. 1 and 2;

FIG. 5 is a perspective view of a motor position photo-encoder which may be used in accordance with the invention;

DETAILED DESCRIPTION OF THE INVENTION

Figure 1:
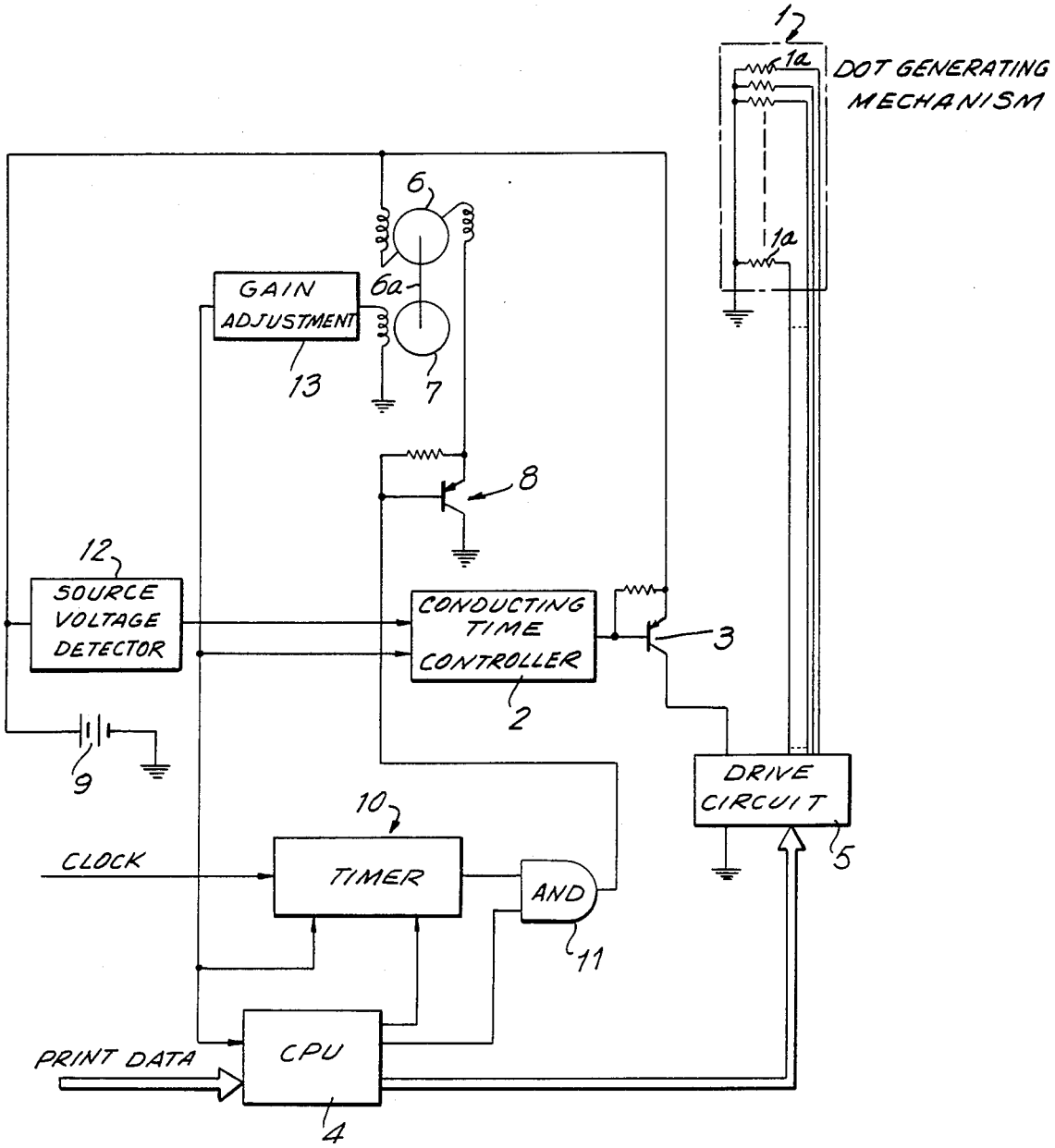
FIG. 1 is a block diagram showing of an embodiment of the print control device of the invention.

Reference is now made to the embodiments of the invention which are shown in the drawings.

Figure 2:
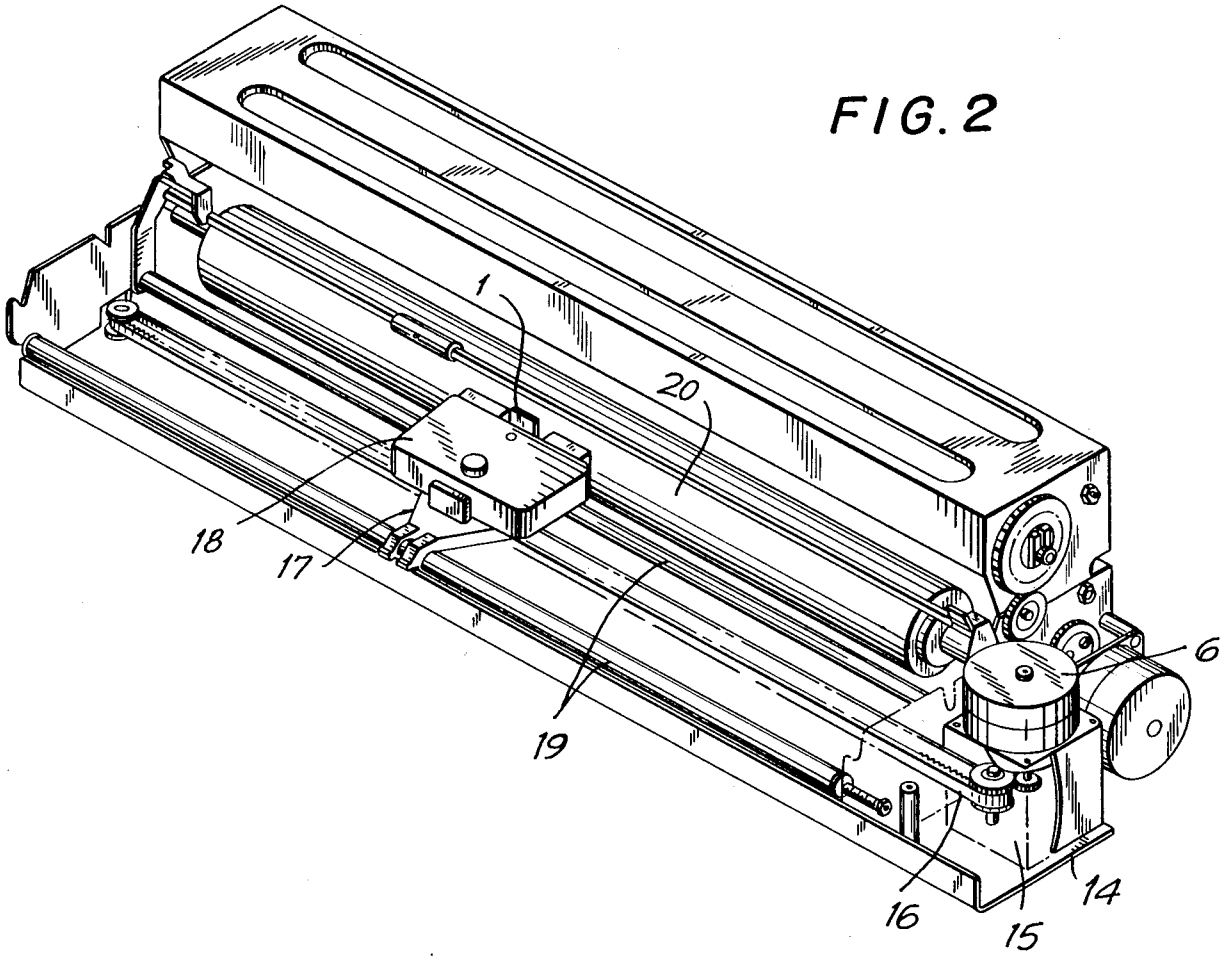
FIG. 2 is a perspective view showing a dot matrix printer to which the print control device of the present invention has been applied.

FIG. 2 shows a dot matrix printer to which the present invention has been applied. In this printer, a DC carriage drive motor 6 is mounted on a base 14 and is coupled via a gear train 15 to a timing belt 16 which runs the length of the machine. A carriage 17 carries a dot generating mechanism 1 and an ink ribbon cartridge 18. The carriage is guided on guide rods 19, and driven by timing belt 16 so as to reciprocate in the axial direction along a platen 20.

In the block diagram of FIG. 1 an embodiment of the print control of present invention is shown in which the dot generating mechanism 1 is schematically represented as a thermal print head which has a plurality of vertically arranged heater element 1*a*. One end of each heater element is connected to ground, and the other end of each heater element is connected to a print element drive circuit 5. Drive circuit 5 is controlled by means of pattern signals given from a CPU (central processing unit) 4 and is connected to a power source 9 through a switching transistor 3. Switching transistor 3 is turned on and off by means of a conducting time control signal which is output from a conducting time controller 2 to be described below. A motor position signal generator 7, which may be a tacho-generator, is coupled to the shaft 6*a* of carriage drive motor 6 for detecting the phase of rotation of the motor. Power for driving DC motor 6 is supplied via a switching transistor 8 from a power source 9, in response to a motor control signal from AND gate 11.

A motor control timer 10 includes, for example, a clock-pulse-driven counter whose counting duration is set by CPU 4. Timer 10 is reset by, and commences counting time in synchronism with, the signal from motor position signal generator 7. It outputs a low level signal to AND gate 11 for predetermined intervals of time. AND gate 11 has an input which receives a motor drive signal from CPU 4 and another input which receives the low signal from timer 10. The motor control signal output by AND gate 11 is connected to the base of switching transistor 8 which connects and disconnects the suppy of DC voltage to DC motor 6.

Conducting time controller 2 has, as inputs, the synchronizing signal from motor position signal generator 7 and a voltage measurement signal from a source voltage detector 12. Detector 12 provides an output signal which is proportional to the voltage of DC source 9. Conducting time controller 2 is reset by, and provides an output in synchronism with, the signal from motor position signal generator 7. The output of controller 2 is a pulse signal whose width is substantially in inverse proportion to the square of the voltage of power source 9. A gain adjusting circuit 13 is provided for setting the signal amplitude output of motor position signal generator 7 to a predetermined level.

Operation of the above-described device will now be described with reference to the waveforms illustrated in FIGS. 3(*a*) and (*b*) where the output of motor position signal generator 7 is a sinusoidal voltage having the form shown in FIGS. 3(*a*) and (*b*).

When normal mode print data, that is, data for printing characters such as are shown in FIG. 4(*a*), is supplied by a host device (not shown), CPU 4 utilizes two cycles of the signal output from motor position signal generator 7 as one print timing cycle and establishes a forbidden time $T_f$ during which the motor drive is off. Forbidden time $T_f$ is set into timer 10. When this preparatory operation has been completed, CPU 4 outputs a DC motor drive signal to AND gate 11. When the signals from timer 10 and the motor drive signal are high, a motor control signal is emitted which turns switching motor transistor 8 on, and power is supplied from power source 9 to DC motor 6. DC motor 6 starts to rotate, moving dot generating mechanism 1 along the width of the paper (not shown) held against the platen.

Meanwhile, driven by DC motor 6, motor position generator 7 outputs the sinusoidal synchronizing signal which corresponds to the angle of rotation of DC motor 6 and, when the phase of the sinusoidal signal reaches a predetermined point, as a zero-crossing point, timer 10 starts to operate and outputs a low signal. Upon receipt of this low signal, AND gate 11 turns motor control switching transistor 8 off terminating the supply of power to DC motor 6. Because it is no longer driven, DC motor 6 slows down while continuing to move dot generating mechanism 1 along the paper. At the same time, e.g., when the predetermined point in the print cycle is reached, conducting time controller 2 outputs a pulse whose width is substantially in inverse proportion to the square of the source voltage, turning on switching transistor 3 and enabling print element drive circuit 5. The conducting time for heat elements is designated as Tw in FIG. 3.

At this time those heat elements 1*a* which have been selected by CPU 4 in response to the print data from the host device, are supplied with heating voltage at a predetermined level for a length of time which is substantially in inverse proportion to the square of the source voltage. Dots of a predetermined density and in the selected pattern are thus printed on the paper. When the time $T_f$ set in timer 10 has elapsed, timer 10 again outputs a high level signal and motor switching transistor 8 is turned on. Power is again supplied to DC motor 6. The average of the motor speed goes down by supplying power to DC motor. Thereafter, DC motor 6 is supplied with power, as described above, until one dot print cycle time corresponding to two cycles of voltage from motor position signal generator 7 has elapsed. When the two cycles of voltage signal from motor position signal generator 7 have passed, timer device 10 again outputs a low level signal, causing the foregoing operation to repeat.

In this way, according to the above embodiment, a dot print cycle is created which corresponds in length to two cycles of the signal voltage from motor position signal generator 7. During each such dot print cycle, the forbidden time for driving the motor and the time for generating dots are made to coincide. As shown in FIGS. 3(*a*) and 3(*b*), the conducting time Tw of $T_w'$ for generating dots overlaps the respective time $T_f$ or $T_f'$ during which the DC motor is decoupled. Thus, while averaging the amount of power or current consumed, full dot patterns corresponding to the print data can be printed.

However, plurality of forbidden times for driving motor may be requested for a character or dot pattern. In a very high speed printing mode such as a draft mode, no forbidden time may be requested for a character or dot pattern. In short, it is possible to select the motor speed easily. Furthermore, it is possible to reduce the time for one line printing if there is no forbidden time during return of the carriage.

Figure 3A:
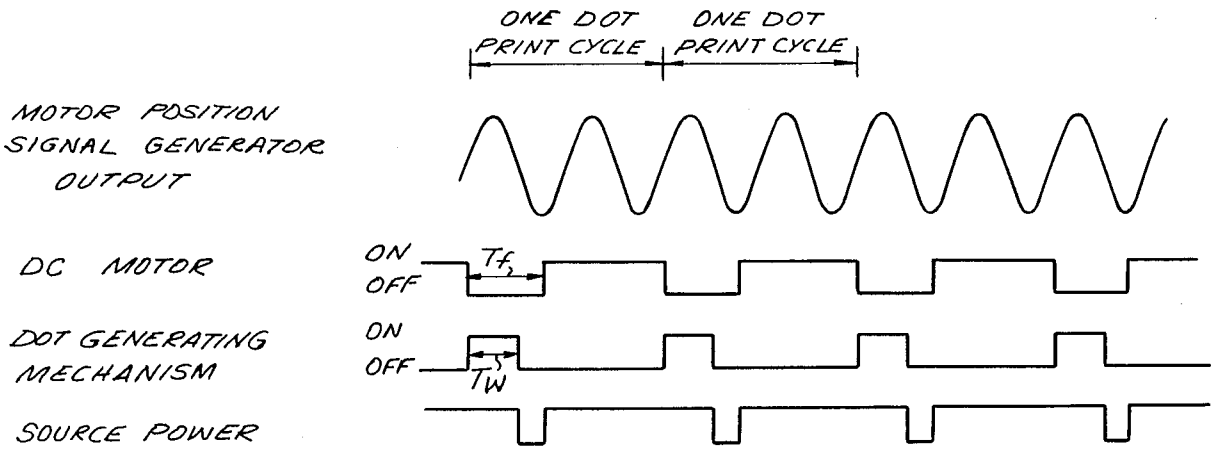
FIGS. 3(*a*) and 3(*b*) are illustrations of the operating wave forms of the device of FIGS. 1 and 2.
Figure 3B:
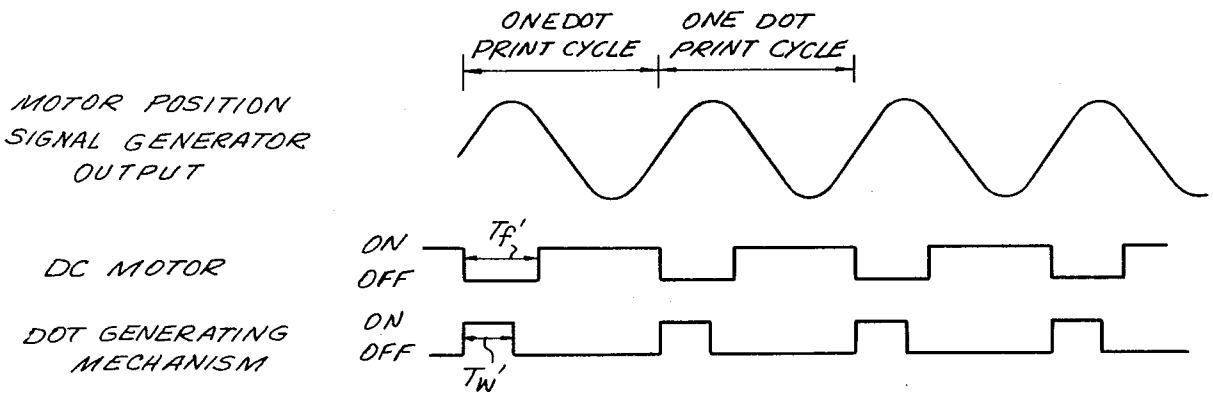

FIG. 3(*a*) is an illustration of the operation in the normal mode.

In a different case, when printing in condensed mode, that is when printing characters of reduced width as shown in FIG. 4(*b*), is called for by the host device, CPU 4 uses one cycle of the sinusoidal voltage output of motor position signal generator 7 as the print cycle. Again, a forbidden time Tf' for the motor drive signal is set into timer device 10. When DC motor 6 starts to rotate and when the phase of the output signal of the motor position signal generator 7 has reached a predetermined point, timer device 10 starts to operate and outputs a low level signal which terminates the supply of power to DC motor 6. Again, DC motor 6 slows down in speed, but continues to move the dot generating mechanism 1. After the motor position signal has reached the predetermined point in phase, conducting time controller 2 outputs a pulse whose width is substantially in inverse proportion to the square of the source voltage, turning on switching transistor 3. Drive circuit 5 is thus put into the operating state and the selected dots are printed by the thermal head. FIG. 3(*b*) is an illustration of the operation in the condensed mode.

However, in the condensed mode, because one print cycle corresponds to one cycle of the signal from motor timing signal generator 7, the time provided for shifting the dot generating mechanism 1 is half of that of the normal mode and the printed character has a pattern whose length in the line direction, or character width, is condensed to half that of the normal mode.

FIG. 5 illustrates the manner in which another construction of motor position signal generator 7, a photo-encoder 21, is mounted on the shaft of carriage drive DC motor 6 in place of the tachometer illustrated above. Photo-encoder 21 has an encoder wheel 22, mounted on the shaft of motor 6, which has a plurality of light reflecting (or absorbing) marks 22*a*, arranged at regular intervals on a circular path. A light source 23 and a light detector 24 are disposed facing encoder wheel 22, completing the photo-encoder. When DC motor 6 turns, a pulsed digital signal is output from light detector 24. The use of the pulsed signal permits simplification of the construction of the signal processing circuitry, as will be apparent to those skilled in the art.

Figure 6:
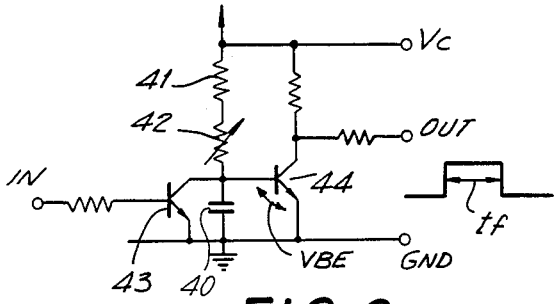
FIG. 6 is a circuit diagram of another embodiment of the timer device according to the present invention.

FIG. 6 is a circuit diagram of another embodiment of the timer device according to the present invention.

40 is a capacitor, 41 is a resistor, 42 is a variable resistor, 43 is a discharging transistor for discharging the capacitor 40 momentarily, and 44 is a comparing transistor for being turned on or off dependent on charging levels of the capacitor 40. When the trigger pulse is applied to the input terminal IN in synchronism with a signal given from motor position signal generator or tacho-generator 7, as described in FIG. 1, the charging of the capacitor commences through the resistors 41 and 42, and the output terminal OUT shows the time during which the charged voltage reaches the voltage VBE between the base and emitter of the comparing transistor 44. The output time is determined by the variable resistor 42.

It is also possible to provide a pulse generating circuit for obtaining the charging and discharging time of the capacitor as a pulse width. In this case, when the voltage of the power source is high, the width of the pulse is short, and when the voltage of the power source is low, the width of the pulse is long. In addition, it is possible to control the speed reduction of the motor according to the variation of the voltage of the power source, by connecting the terminal Vc with the power source and further, it is possible to improve the printing quality.

Figure 7:
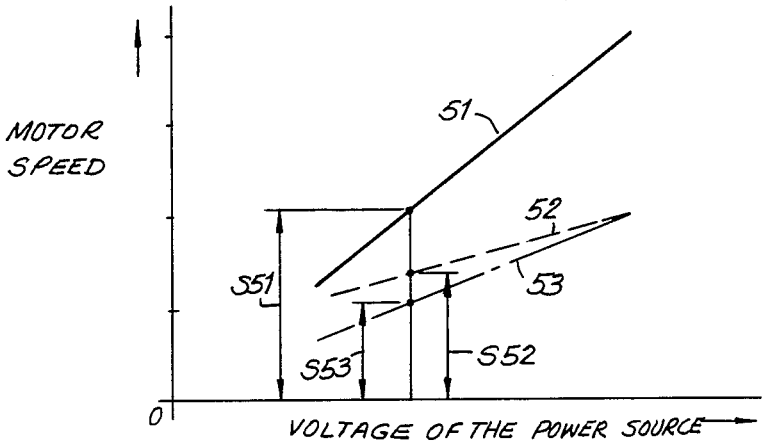
FIG. 7 shows the characteristic of the motor speed.

FIG. 7 shows the characteristic of the motor speed. 51 is a characteristic at the normal mode, wherein the motor speed is reduced, dependent on the reduction of the voltage of the power source with one curved line. 52 shows the relation between the motor speed and the voltage of the power source in the condensed mode with the timer device utilized in the embodiment of FIG. 1. 53 shows the relation between the motor speed and the voltage of the power source in the condensed mode with the timer device as shown in FIG. 6. In this case, the terminal Vc of the power source is connected to the power source. S51, S52, and S53 show respective motor speeds to a voltage of the power source in the respective characteristic lines. The ratio of S52 to S51, that is, S52/S51 is not constant. However, it is possible to substantially equalize the ratio of S53 to S51, that is, S53/S51, over the wide range of the voltages. In the latter case, the perod of the motor speed is increased in the low voltage, thereby it is possible to obtain the sufficient time for cooling the thermal head and to improve the printing quality.

Figure 8:
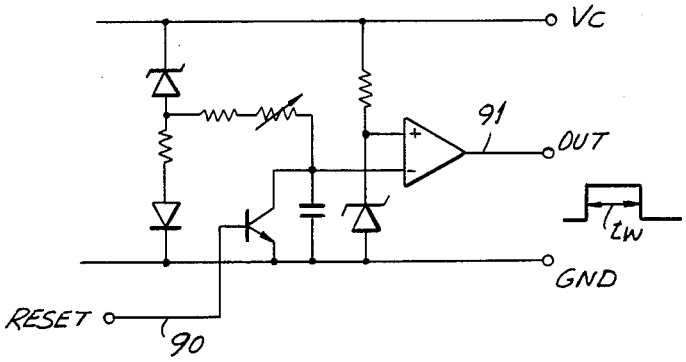
FIG. 8 shows one embodiment of the conducting time controller having a source voltage detector, according to the present invention.

FIG. 8 shows one embodiment of the conducting time controller having a source voltage detector, according to the present invention. A detailed description concerning the operation of the controller is omitted, as it is described in U.S. Pat. No. 4,409,600 filed by the same inventor.

When the reset signal is applied to the reset terminal 90 in synchronism with the motor position signal generator, a pulse whose width $T_w$ is in inverse proportion substantially to the square of the voltage applied to the terminal Vc of the power source is outputted to the output terminal 91.

As will be apparent from the foregoing description, tne present invention provides averaging downwards of the peak power requirements of the printer, since the movement of the carriage and the dot generating mechanism by the DC printing motor is restricted to a different time in the print cycle than that during which characters are formed on the print paper. Further, since timing is synchronized with rotation of the DC motor, a servo control mechanism is not required and the cost of the carriage moving mechanism is reduced. Also, movement of the dot generating mechanism can be achieved smoothly without overshooting such as is apt to occur in the case of servo control system.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

What is claimed is:

1. A print control device for use in a dot matrix printer, the dot matrix printer comprising a DC power source and a print generating mechanism which is moved along the length of a platen by DC motor coupled to the DC power source, the print control device comprising:

detecting means for responding to rotation of the DC motor to provide a synchronizing signal which is related to the angular position of the DC motor;

timer means responsive to the synchronizing signal to provide a signal for decoupling the DC motor from the DC power source for a predetermined period of time;

controller means responsive to the synchronizing signal for energizing the print generating mechanism during the predetermined period of time;

switch means coupled between the DC power source and the DC motor, the switch means responsive to the decoupling signal to cut off the supply of DC power to the motor;

gate means having a first input receiving the decoupling signal from the timer means, a second input, and an output coupling to the switch means; and computer means having the synchronizing signal and a print data signal as inputs, the computer means having a print control signal as an output which is fed to the second input of the gate means, the gate means responding to the absence of a decoupling control signal and to the presence of a print signal to energize the DC motor.

2. A print control device for use in a dot matrix printer, the dot matrix printer comprising a DC power source and a print generating mechanism which is moved along the length of a platen by a DC motor coupled to the DC power source, the print control device comprising:

detecting means for responding to rotation of the DC motor to provide a synchronizing signal which is related to the angular position of the DC motor;

timer means responsive to the synchronizing signal for decoupling the DC motor from the DC power source for a predetermined period of time; and conducting time controller means responsive to the synchronizing signal for energizing the print generating mechanism during the predetermined period of time so that the period of time for energizing the print generating mechanism at least partly overlaps the time that the DC motor is decoupled from the DC power source, wherein the timer means for decoupling the DC motor is a timer circuit comprising a capacitor whose charging and discharging time establishes the predetermined period of time.

3. The print control device of claim 2 and further comprising:

means responsive to the synchronizing signal for initiating the charging of the capacitor at the start of the predetermined period.

4. The print control device of claim 3 and further comprising:

means for comparing the voltage on the capacitor with a predetermined voltage to stop charging of the capacitor.

5. The print control device of claim 4 in which the capacitor of the timer circuit is charged through a resistance which can be varied to change the predetermined period of time.

6. A print device in accordance with claim 2 in which the average speed of the DC motor is reduced as a result of being periodically decoupled from the DC power source, the voltage available at the DC power source has a varying level, and the timer circuit is coupled to the DC power source and responds to the available DC voltage level to control the average speed of the DC motor.

7. A print control device for use in a dot matrix printer, the dot matrix printer comprising a DC power source and a print generating mechanism which is moved along the length of a platen by a DC motor coupled to the DC power source, the print control device comprising:

detecting means for responding to rotation of the DC motor to provide a synchronizing signal which is related to the angular position of the DC motor;

timer means responsive to the synchronizing signal for decoupling the DC motor from the DC power source for a predetermined period of time; and conducting time controller means responsive to the synchronizing signal for energizing the print generating mechanism during the predetermined period of time so that the period of time for energizing the print generating mechanism at least partly overlaps the time that the DC motor is decoupled from the DC power source, wherein the timing means further comprises:

resistance-capacitance circuit means coupled to the DC power source;

means responsive to the synchronizing signal for initiating charging of the capacitance of the response-capacitance circuit means to start generation of the predetermined period;

means for stopping generation of the predetermined period when the level of the voltage on the capacitance has reached a predetermined level; and switch means coupled between the DC power source and the DC motor, the switch means responsive to the predetermining period to cut off the DC motor from the DC power source.

8. A print control device in accordance with claim 7 in which the resistance of the resistance-capacitance circuit is a variable resistor by means of which the predetermined period of time may be varied.

9. The print control device of claim 1 wherein the print generating mechanism is responsive to a pattern signal and the timing means is responsive to a motor drive signal and a timer control signal, and further comprising:

computer means having print data signals as an input, the computer means having the pattern signals, the motor drive signal, and the timer control signal as outputs, the computer means being responsive to the print data signals to regulate the speed of the DC motor.

10. A print control device for use in a dot matrix printer, the dot matrix printer comprising a DC power source and a print generating mechanism which is moved along the length of a platen by a DC motor coupled to a pattern signal, the print control device comprising:

detecting means for responding to rotation of the DC motor to provide a synchronizing signal which is related to the angular position of the DC motor;

timer means responsive to the synchronizing signal, a motor drive signal, and a timer control signal for decoupling the DC motor from the DC power source for a predetermined period of time;

conducting time controller means responsive to the synchronizing signal for energizing the print generating mechanism during the predetermined period of time so that the period of time for energizing the print generating mechanism at least partly overlaps the time that the DC motor is decoupled from the DC power source; and computer means having the print data signals as an input, the computer means having the pattern signals, the motor drive signal, and the timer control signal as outputs, the computer means being responsive to the print data signals to regulate the speed of the DC motor, wherein the timer means further comprises:

a timer having a motor timing signal as an output;

switch means coupled between the DC power source and the DC motor, the switch means responsive to a decoupling signal to cut off the supply of DC power to the DC motor; and coincidence detection means having a first input to which the motor timing signal from the timer is coupled, a second input to which the motor drive signal from the computer means is coupled, and an output which provides the decoupling signal for the switch means.

11. The print control device of claim 10 wherein the duration of the motor timing signal produced by the timer is controlled by the timing control signal from the computer in response to one of a single cycle and a plurality of cycles of the synchronizing signal.

12. A print control device for use in a dot matrix printer, the dot matrix printer comprising a DC power source and a print generating mechanism which is moved along the length of a platen by a DC motor coupled to the DC power source, the print control device comprising:

detecting means for responding to rotation of the DC motor to provide a synchronizing signal which is related to the angular position of the DC motor;

timer means responsive to the synchronizing signal, the timer means providing a conducting time control signal for decoupling the DC motor from the DC power source for a predetermined period of time;

conducting time controller means responsive to the synchronizing signal for energizing the print generating mechanism during the predetermined period of time so that the period of time for energizing the print generating mechanism at least partly overlaps the time that the DC motor is decoupled from the DC power source;

drive means connected to the print generating mechanism and having an input for DC power; and switch means for connecting the DC power input of the drive means to the DC power source, the switch means having the conducting time control signal as an input and reponding thereto to energize the print generating mechanism.

* * * * *